US005243939A

United States Patent [19]

Viktorsson et al.

[11] Patent Number: 5,243,939

[45] Date of Patent: Sep. 14, 1993

[54] MOTOR SAW

[75] Inventors: Per O. Viktorsson, Huskvarna; Hans I. Ström, Kode, both of Sweden

[73] Assignee: Aktiebolaget Electrolux, Stockholm, Sweden

[21] Appl. No.: 953,553

[22] Filed: Sep. 29, 1992

[30] Foreign Application Priority Data

Oct. 14, 1991 [SE] Sweden ..... 9102969

[51] Int. Cl.[5] ..... F02B 77/00

[52] U.S. Cl. ..... 123/198 E; 30/381

[58] Field of Search ..... 123/73 A, 73 B, 73 C, 123/195 A, 198 E; 30/381

[56] References Cited

U.S. PATENT DOCUMENTS 4,285,309 8/1981 Johansson ..... 123/195 C
4,788,951 12/1988 Nagashima ..... 123/198 E
5,065,708 11/1991 Wehle et al. ..... 123/73 C

FOREIGN PATENT DOCUMENTS 459354 6/1989 Sweden .

*Primary Examiner*—Noah P. Kamen
*Attorney, Agent, or Firm*—Pearne, Gordon, McCoy & Granger

[57] ABSTRACT

In a motor saw comprising an engine portion and a handle portion, the engine portion comprises a carburetor (17) located in a separate carburetor chamber (13) and connected to the cylinder (10) of the engine by means of a flexible inlet tube (18) passing through a partition wall (15) between the carburetor and the cylinder. For reducing vibrations transmitted to the carburetor, a supporting means is provided between the carburetor and the handle portion. The supporting means comprises a link (22) which is articulately connected to the carburetor as well as to the handle portion.

3 Claims, 2 Drawing Sheets

MOTOR SAW

BACKGROUND OF THE INVENTION

The present invention relates to a motor saw comprising an engine portion and a handle portion, said engine portion comprising a carburetor located in a separate carburetor chamber and connected to the cylinder of the engine by means of a flexible inlet tube passing through a partition wall between the carburetor and the cylinder.

Due to requirements of reduction of exhaust gas emissions from motor saws a very accurate adjustment of the carburetor is necessary. However, such adjustment can be lost if the carburetor is exposed to heavy vibration. A primary condition of keeping an accurate adjustment is that the carburetor is insulated from heat radiation and vibrations from the motor.

It is previously known to attach the carburetor firmly to a carburetor chamber and to provide a flexible connection to the engine by means of an inlet tube of rubber, whereby the carburetor is less exposed to engine vibrations. Such an arrangement of a carburetor is known from Swedish Patent 8602481-7.

SUMMARY OF THE INVENTION

A motor saw body generally comprises an engine portion and a handle portion which are interconnected by means of vibration insulating elements in order that the operator is not exposed to inconvenience when holding the handles. Thus, a carburetor firmly mounted to the handle portion has a reduced vibration level as compared to the engine portion. A possibility of further reducing the vibration of the carburetor is to provide a flexible attachment thereof to the handle or the engine portion.

According to the invention, an arrangement has been provided which ensures reduced vibrations and good thermal insulation from the engine in order to obtain good possibilities of adjusting and keeping the correct air/fuel mixture of the engine. Further advantages are also obtained, such as

- reduction of the problem of evaporating fuel in the carburetor,
- reduced wear of the needle valve in the fuel chamber of the carburetor,
- devibration of the air filter results in more efficient air filtering, since particles will not bounce against the filter surface.

These advantages are obtained by a motor saw as described in the introduction which according to the invention is generally characterized by a supporting means provided between said carburetor and said handle portion, said supporting means comprising a link articulately connected to the carburetor as well as to the handle portion.

DETAILED DESCRIPTION OF THE INVENTION

Figure 1:
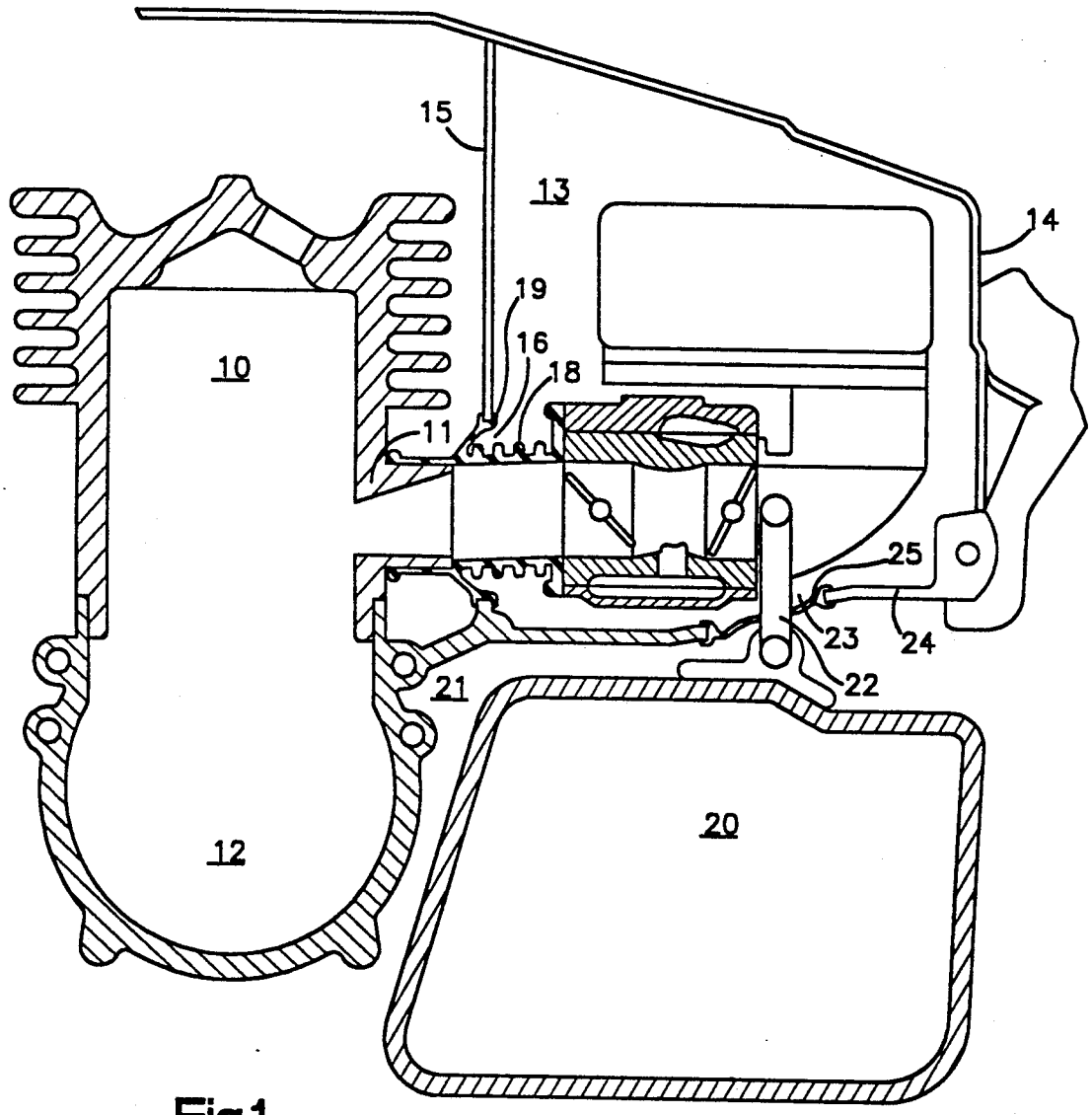
FIG. 1 shows a cross-sectional view of a first embodiment of the invention.

An embodiment of the invention will be described following with reference to the accompanying drawing in which is shown a rear portion of a motor saw body provided with a carburetor chamber and a carburetor.

The engine portion of the saw comprises a cylinder 10 of an air-cooled two-cycle engine having an inlet tube socket 11, a crank housing 12 the bottom wall of which constitutes a portion of the saw housing, and a carburetor chamber 13 forming a further housing portion 14. The carburetor chamber is separated from the engine by a partition wall 15 having an opening 16 coaxial with the tube socket 11. The partition wall prevents heat radiation from the cylinder to a carburetor 17 which could otherwise become too hot when the engine has stopped. An inlet gas tube 18 passes through the opening 16 from the carburetor to the engine. The tube has a collar 19 which is sealingly connected to the rim of the opening 16. One end of the tube sealingly engages the outside of the tube socket 11 and the other end is attached to the carburetor by means of a screw connection. The tube is made of elastomer and absorbs vibrations from the engine.

The so-called handle portion of the saw body comprises i.a. a fuel tank 20. A gap 21 between the engine and handle portions allows the engine portion to move relative to the handle portion. The saw body portions are interconnected by means of devibration elements provided between the two main portions. A further interconnection is provided by means of an articulated link 22 extending through an opening 23 in the bottom wall 24 of the carburetor chamber. This opening is sealed off by a diaphragm 25 attached to the rim of the opening. The link permits free movement of the carburetor in a plane extending in the longitudinal direction of the saw body. The carburetor can thus be turned or moved in parallel in this plane in order to absorb vibrations transmitted via tube 18 from the engine.

Due to the articulate interconnection of the carburetor and the handle portion the vibration of the oarburetor has been reduced. In order to obtain further reduction of the transmission of vibrations in a vertical plane, the link may be articulately connected to the carburetor and the handle portion by elastic pins (not shown).

Figure 2:
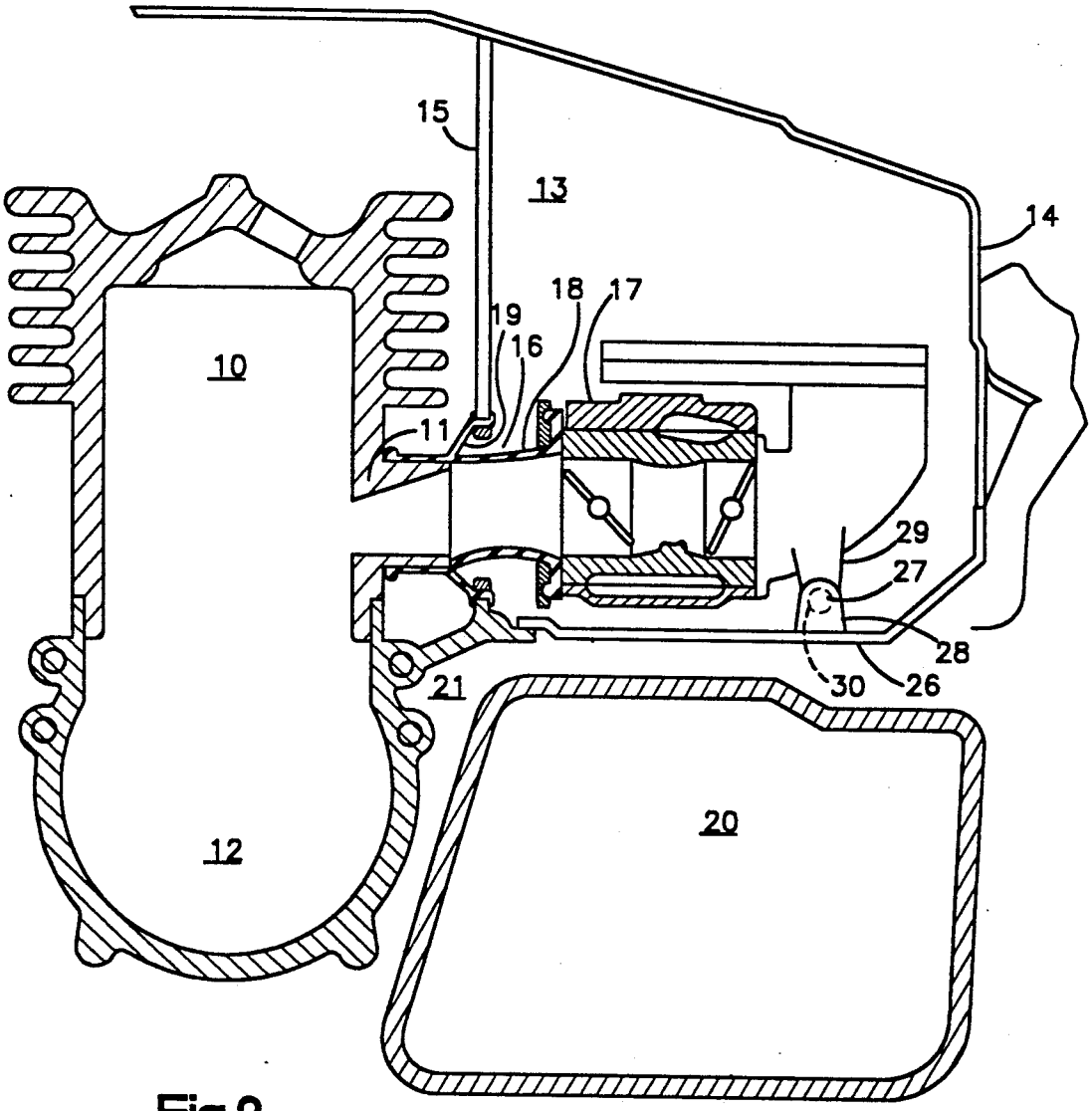
FIG. 2 shows a cross-sectional view of a second embodiment of the invention.

FIG. 2 shows a leg 29 connected to the carburetor 17 and articulated at pin 30 by a link 27 and supported by journals 28 on bottom wall 26.

We claim:

1. Motor saw comprising an engine portion and a handle portion, said engine portion comprising a carburetor (17) located in a separate carburetor chamber (13) and connected to the cylinder (10) of the engine by means of a flexible inlet tube (18) passing through a partition wall (15) between the carburetor and the cylinder, characterized by a supporting means provided between said carburetor and said handle portion, said supporting means comprising a link (22) articulately connected to the carburetor as well as to the handle portion.

2. Motor saw according to claim 1, characterized in that the link (22) extends through an opening (23) in the bottom wall (24) of the carburetor chamber, said opening being sealed off by means of an elastic diaphragm (25).

3. Motor saw according to claim 1 or 2, characterized in that one end of the link (22) is connected to the top wall of a fuel tank (20) forming part of the handle portion.

* * * * *